US010723153B2

(12) United States Patent
Ohashi et al.

(10) Patent No.: US 10,723,153 B2
(45) Date of Patent: Jul. 28, 2020

(54) INKJET PRINTING APPARATUS

(71) Applicant: CANON KABUSHIKI KAISHA, Tokyo (JP)

(72) Inventors: Tetsuyo Ohashi, Yokohama (JP); Yasuyuki Takanaka, Yokohama (JP); Tetsuya Ishikawa, Yokohama (JP); Seiji Ogasawara, Machida (JP); Noriko Sato, Kawasaki (JP); Akira Kida, Yokohama (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/880,635

(22) Filed: Jan. 26, 2018

(65) Prior Publication Data

US 2018/0236791 A1 Aug. 23, 2018

(30) Foreign Application Priority Data

Feb. 17, 2017 (JP) ..... 2017-028020

(51) Int. Cl.
*B41J 11/13* (2006.01)
*B41J 25/304* (2006.01)
(Continued)

(52) U.S. Cl.
CPC ..... *B41J 11/13* (2013.01); *B41J 2/155* (2013.01); *B41J 11/06* (2013.01); *B41J 13/0027* (2013.01);
(Continued)

(58) Field of Classification Search
CPC ..... B41J 11/007; B41J 11/20; B41J 25/304; B41J 25/316; B41J 2/16588; B65H 1/266; B65H 1/04
See application file for complete search history.

(56) References Cited

U.S. PATENT DOCUMENTS 5,797,068 A 8/1998 Otsuki et al.
6,068,374 A 5/2000 Kurata et al.
(Continued)

FOREIGN PATENT DOCUMENTS

CN 104003218 A 8/2014
JP H09-77288 A 3/1997
(Continued)

OTHER PUBLICATIONS

Machine Translation of JP2014065293 (A)—Retrieved from WIPO PATENTSCOPE Jun. 6, 2019. (Year: 2019).*
(Continued)

*Primary Examiner* — John Zimmermann
(74) *Attorney, Agent, or Firm* — Venable LLP

(57) ABSTRACT

An inkjet printing apparatus includes a stacking unit, a print head having an ejection opening surface located vertically above the stacking unit, and a platen that supports a back side of a print medium at an angle greater than 40° and less than 50° with respect to a horizontal direction. A discharging unit is located vertically above the print head, and a print medium subjected to printing by the print head is discharged onto the discharging unit. A conveying unit conveys a print medium, subjected to printing by the print head, vertically upward toward the discharging unit. In addition, the ejection opening surface faces the platen in a case in which the inkjet printing apparatus is in a printing state, and faces downward with respect to a direction of gravity in a case in which the inkjet printing apparatus is in a standby state.

14 Claims, 8 Drawing Sheets

(51) Int. Cl.

| | |
|---|---|
| ***B41J 2/155*** | (2006.01) |
| ***B41J 13/00*** | (2006.01) |
| ***B41J 13/10*** | (2006.01) |
| ***B41J 11/06*** | (2006.01) |
| *G03G 15/00* | (2006.01) |

(52) U.S. Cl.

CPC ..... *B41J 13/0036* (2013.01); *B41J 13/103* (2013.01); *B41J 25/304* (2013.01); *B65H 2405/324* (2013.01); *G03G 15/6514* (2013.01)

(56) References Cited

U.S. PATENT DOCUMENTS

| | | | | |
|---|---|---|---|---|
| 6,801,749 | B2 * | 10/2004 | Yasui | G03G 15/657 399/110 |
| 8,876,280 | B2 | 11/2014 | Ishikawa et al. | |
| 8,995,879 | B2 * | 3/2015 | Seike | G03G 21/16 399/124 |
| 9,242,491 | B2 * | 1/2016 | Miyashita | B41J 3/4071 |
| 9,323,203 | B2 | 4/2016 | Kawashima | |
| 2004/0141787 | A1 * | 7/2004 | Inokuchi | B41J 3/4071 400/582 |
| 2006/0132554 | A1 * | 6/2006 | Ota | B41J 2/17556 347/85 |
| 2008/0158321 | A1 * | 7/2008 | Nitta | B41J 2/175 347/89 |
| 2009/0073213 | A1 * | 3/2009 | Iwata | B41J 2/16588 347/19 |
| 2011/0001284 | A1 | 1/2011 | Ohtsuki | |
| 2013/0076831 | A1 * | 3/2013 | Ishida | B41J 2/16588 347/37 |
| 2013/0100205 | A1 * | 4/2013 | Sunouchi | B41J 2/175 347/37 |
| 2014/0043394 | A1 | 2/2014 | Ishikawa et al. | |
| 2014/0203499 | A1 | 7/2014 | Lo et al. | |
| 2014/0232768 | A1 | 8/2014 | Miyashita et al. | |
| 2014/0241775 | A1 | 8/2014 | Kawashima | |

FOREIGN PATENT DOCUMENTS

| | | | |
|---|---|---|---|
| JP | 2004-029846 | A | 1/2004 |
| JP | 2004-269124 | A | 9/2004 |
| JP | 2012-206353 | A | 10/2012 |
| JP | 2014-065293 | A | 4/2014 |
| JP | 2016-124242 | A | 7/2016 |

OTHER PUBLICATIONS

Extended European Search Report dated Jul. 4, 2018, in European Patent Application No. 18000021.8.

U.S. Appl. No. 15/891,807, Tetsuyo Ohashi Yasuyuki Takanaka Tetsuya Ishikawa Seiji Ogasawara Noriko Sato Akira Kida Noboru Shimoyama, filed Feb. 8, 2018.

Japanese Office Action dated Apr. 15, 2019, issued in Japanese Patent Application No. 2017-028020.

Dec. 18, 2019 Chinese Official Action in Chinese Patent Appln. No. 20181012353.5.

Apr. 14, 2020 European Official Action in European Patent Appln. No. 18000021.8.

* cited by examiner

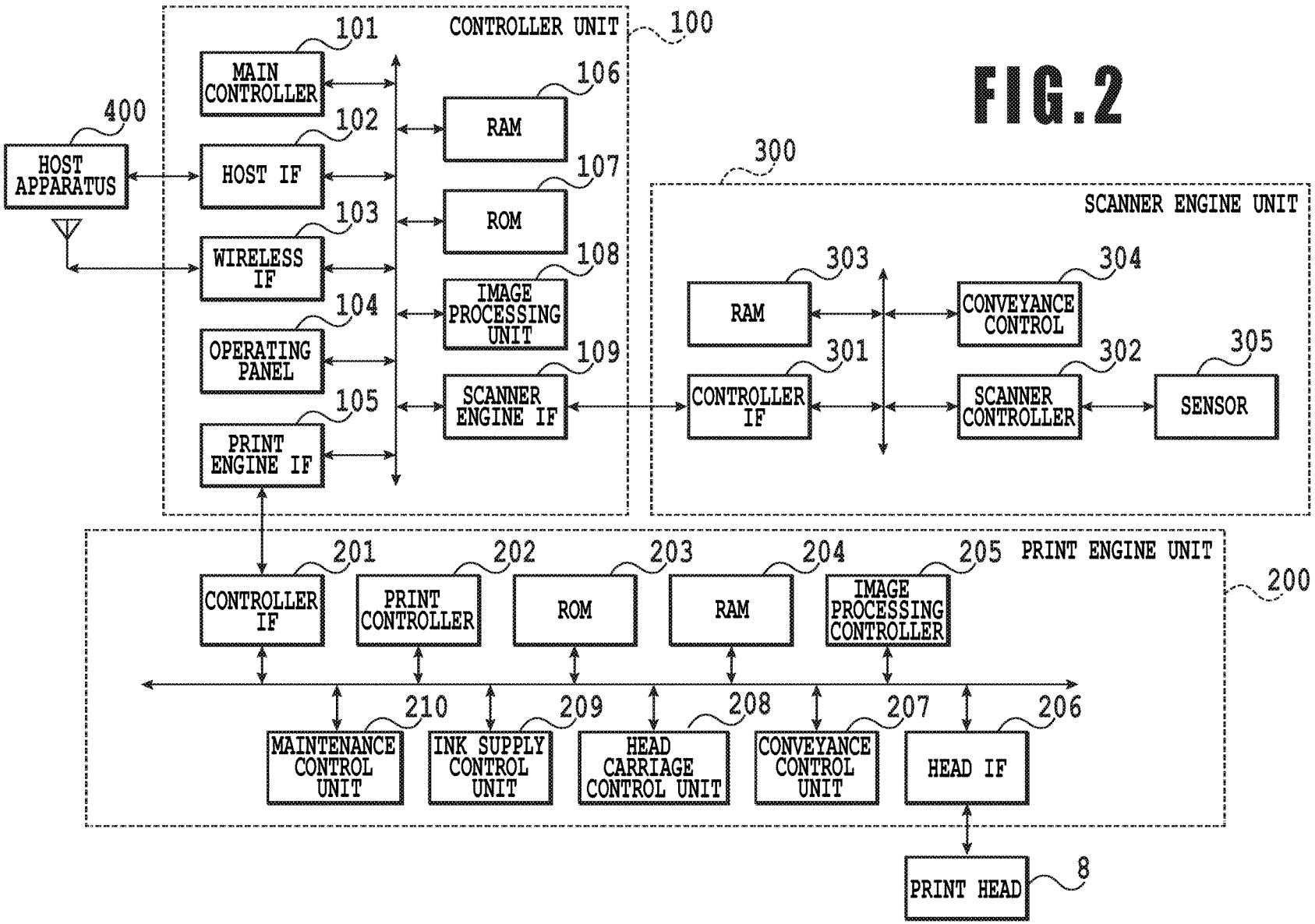
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
CONVEYANCE CONTROL
304
SCANNER CONTROLLER
302
SENSOR
305
RAM
303
CONTROLLER IF
301
PRINT ENGINE UNIT
200
CONTROLLER IF
201
PRINT CONTROLLER
202
ROM
203
RAM
204
IMAGE PROCESSING CONTROLLER
205
HEAD IF
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8

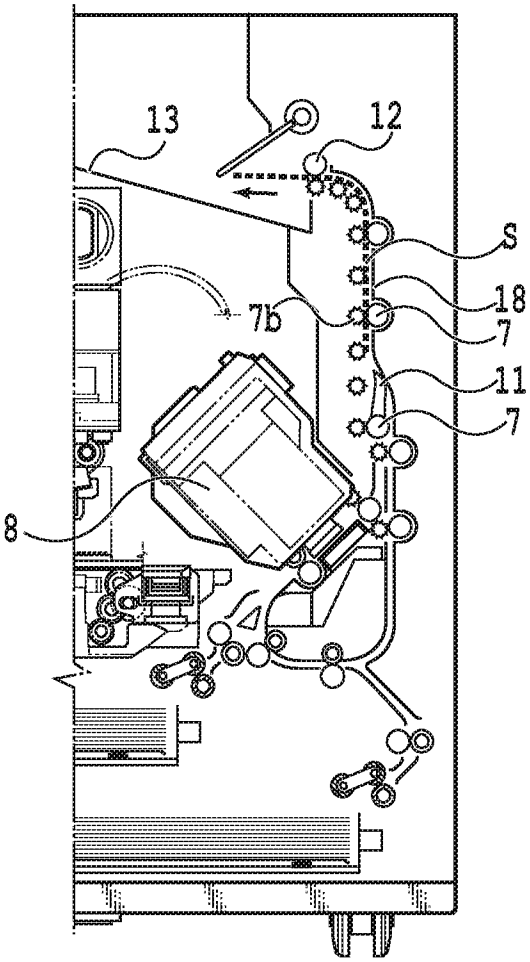
FIG.4C
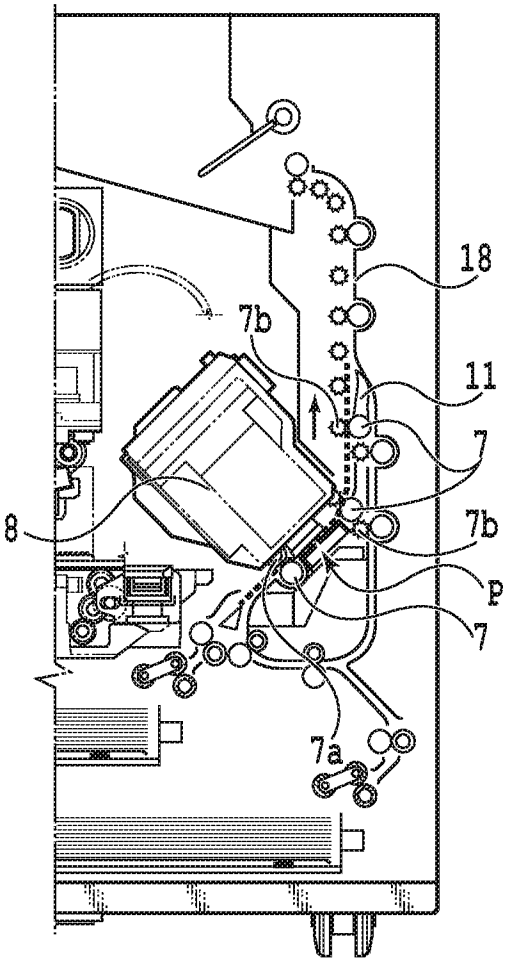
FIG.4B
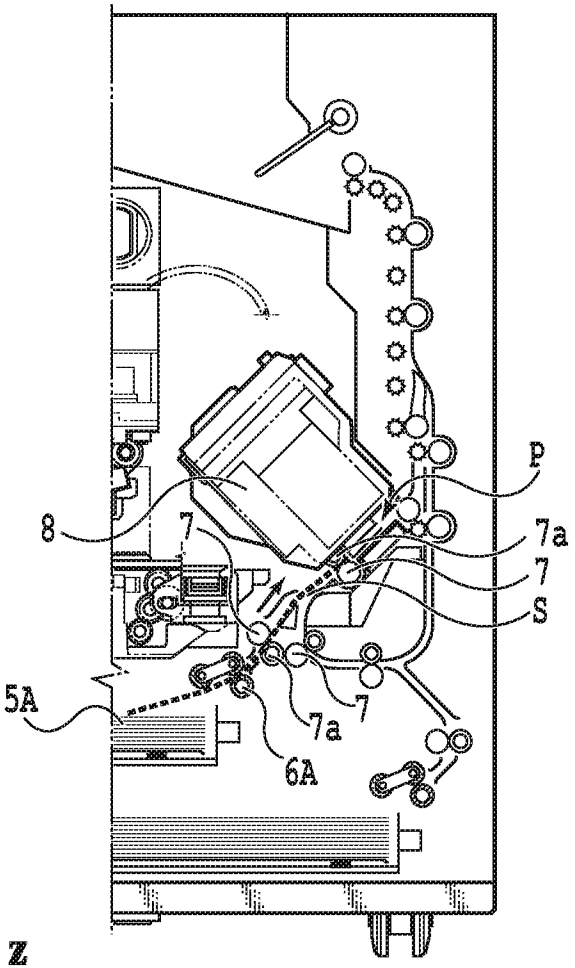
FIG.4A
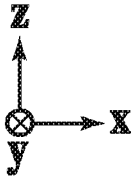

INKJET PRINTING APPARATUS

BACKGROUND OF THE INVENTION

Field of the Invention

The present invention relates to an inkjet printing apparatus comprising a print head that ejects ink to print an image.

Description of the Related Art

U.S. Patent Application Publication No. 2014/0203499 discloses an inkjet printing apparatus configured to convey a print medium, placed horizontally on a feeding tray at the bottom of the apparatus, to a position facing a print head, perform printing, and then further convey the print medium vertically upward, and discharge it into a discharging tray located above the feeding tray. The print medium is subjected to printing by the print head while being kept horizontal, and is then conveyed vertically upward.

However, in the configuration disclosed in U.S. Patent Application Publication No. 2014/0203499, the print head applies ink to the print medium fed from the feeding tray while the print medium is being conveyed horizontally, and then the conveying direction is changed to the vertically upward direction by roller pairs located downstream of the print head. As a result, a strong contact pressure is generated between the printed side immediately after the application of ink and the roller pairs in contact with the printed side, which may decrease the quality of an image on the printed side. Further, ink may adhere to the rollers and the ink may be transferred to a non-printed area of the same print medium or a subsequent printing medium, which may also decrease the image quality.

SUMMARY OF THE INVENTION

In consideration of the problem described above, an object of the present invention is to provide an inkjet printing apparatus capable of improving the quality of an image on a print medium in a configuration of feeding the print medium which is kept horizontal, performing printing by the use of a print head, and conveying the print medium vertically upward.

According to an aspect of the present invention, there is provided an inkjet printing apparatus comprising a stacking unit configured to stack printing medium substantially horizontally, a print head having an ejection opening surface located vertically above the stacking unit, on which a plurality of ejection openings for ejecting ink are provided, the print head being configured to perform printing by ejecting ink to a print medium fed from the stacking unit, a platen configured to support the back side of a print medium in a position facing the ejection opening surface of the print head, a discharging unit located vertically above the print head, on which a print medium subjected to printing by the print head is discharged, and a conveying unit configured to convey a print medium, subjected to printing by the print head, vertically upward toward the discharging unit, wherein the platen supports the back side of a print medium at an angle greater than 0° and less than 90° with respect to a horizontal direction.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
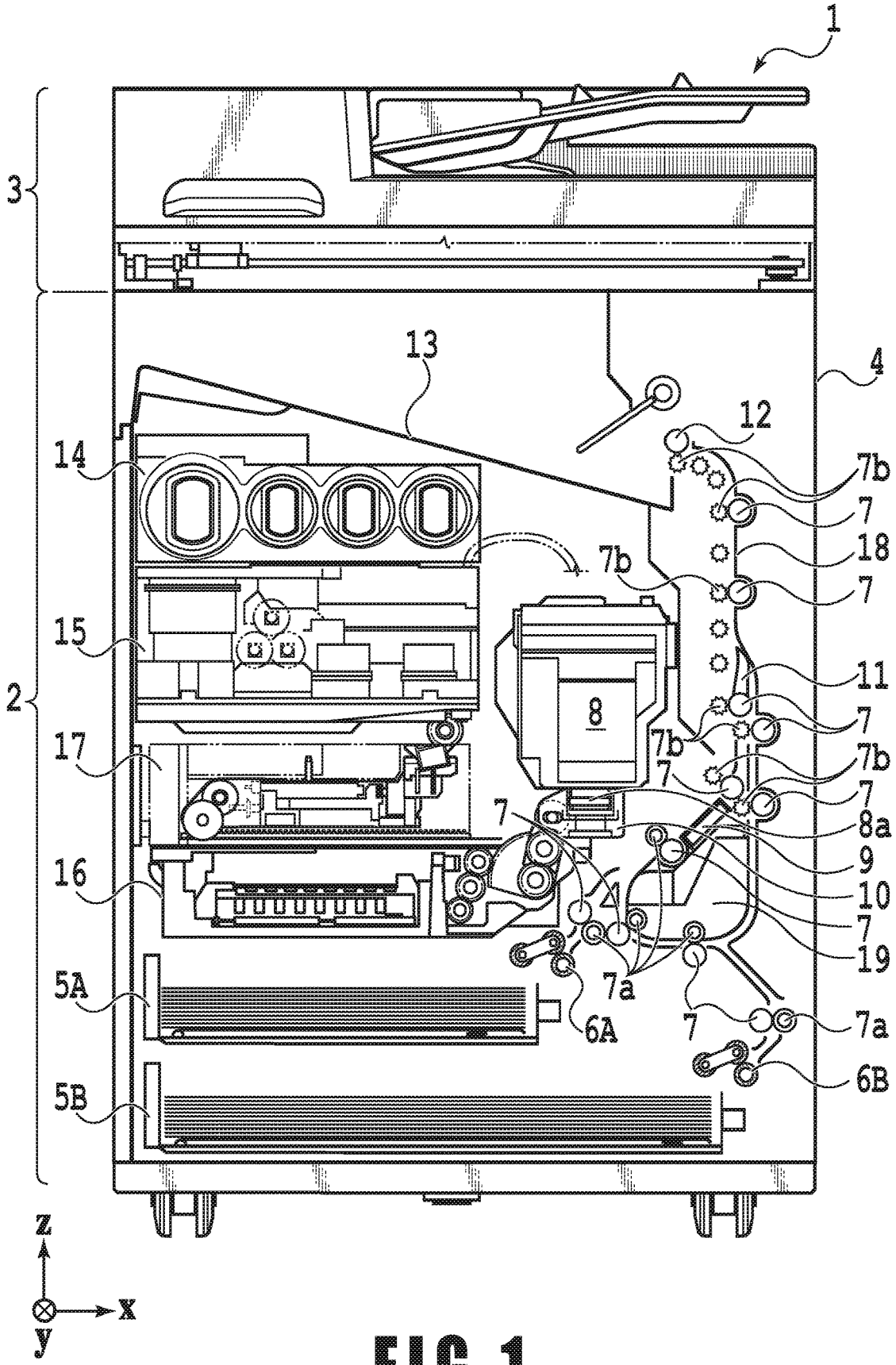
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately, or in synchronization, to perform various processes related to a print operation and a scan operation. The scanner unit 3 comprises an automatic document feeder (ADF) and a flatbed scanner (FBS), and is capable of scanning a document automatically fed by the ADF, as well as, scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither the print operation nor the scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A, and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In the print operation, a print medium S is selectively fed from either one of the cassettes 5A and 5B.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to the print operation and discharged by the discharging roller 12.

The print head 8 of the present embodiment is a full line type color inkjet print head. In the print head 8, a plurality of ejection openings, configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In the print operation, the orientation of the print head 8 is changed by a print controller 202, described later, such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform a maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or a wired communication, or acquire image data from an external storage unit (such as a USB memory) connected to the printing apparatus 1. A communication system used for the wireless or the wired communication is not limited. For example, as a communication system for the wireless communication, Wireless Fidelity (Wi-Fi®) and Bluetooth® can be used. As a communication system for the wired communication, a USB (Universal Serial Bus), and the like, can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform an operation, such as copying and scanning, set a print mode, and recognize information about the printing apparatus 1 via the operating panel 104.

In the print engine unit 200, the print controller 202, including a CPU, controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for the print operation. After the generation of the print data, the print controller 202 allows the print head 8 to perform the print operation based on the print data via a head I/F 206. At this time, the print controller 202 conveys a print medium S by driving the feeding units 6A and 6B, the conveying rollers 7, the discharging roller 12, and the flapper 11 shown in FIG. 1 via a conveyance control unit 207. The print head 8 performs the print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and the wiping unit 17 in the maintenance unit 16 when performing the maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform the print operation based on the image data scanned by the scanner controller 302.

Figure 3:
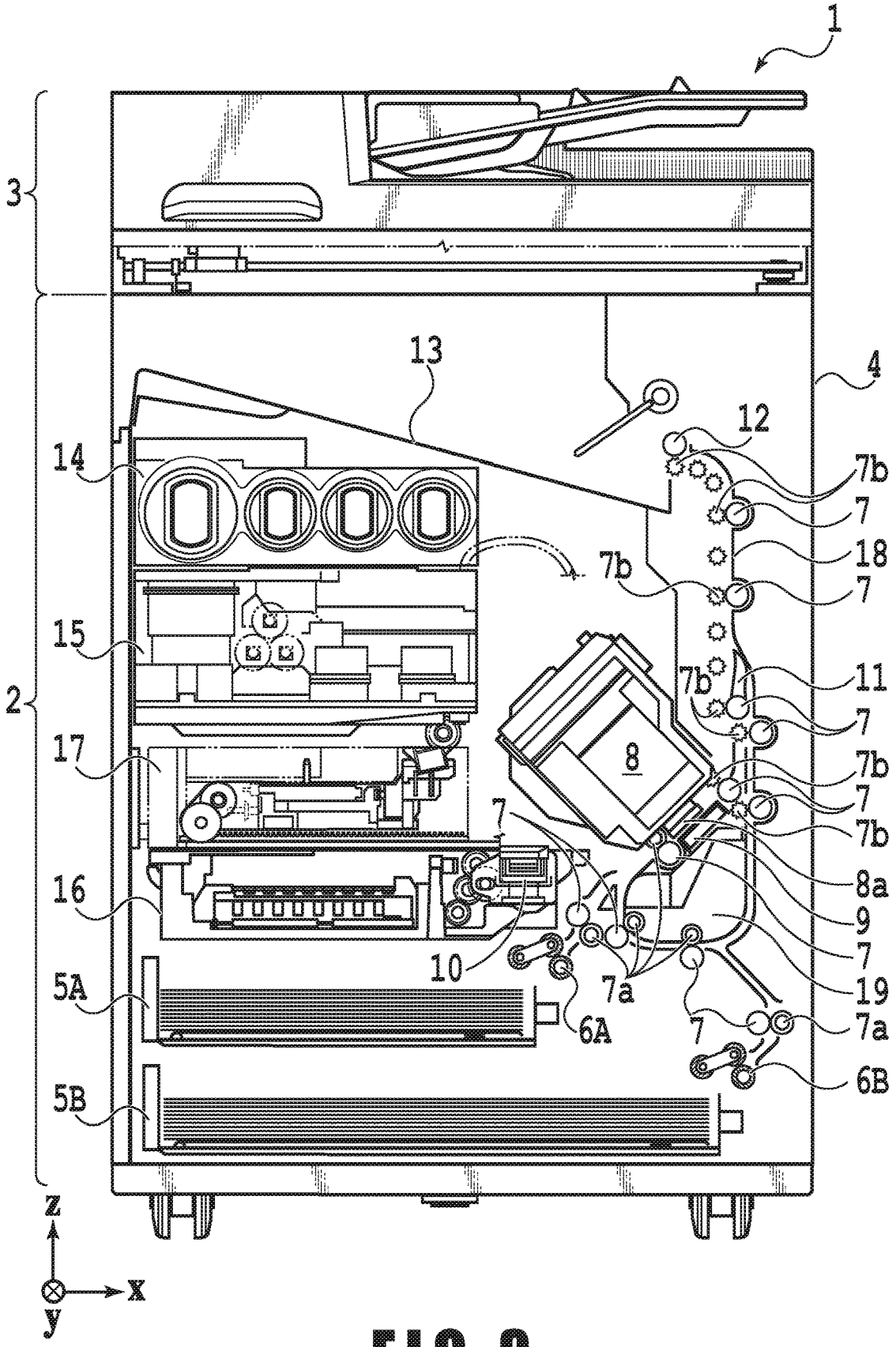
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of the print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
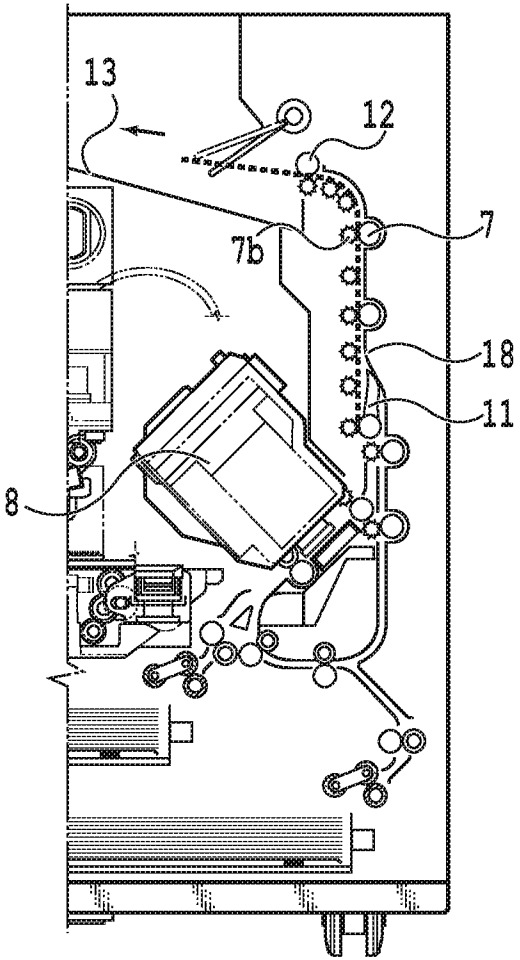
FIGS. 5A to 5C are conveying path diagrams of a print medium fed from a second cassette.
Figure 5B:
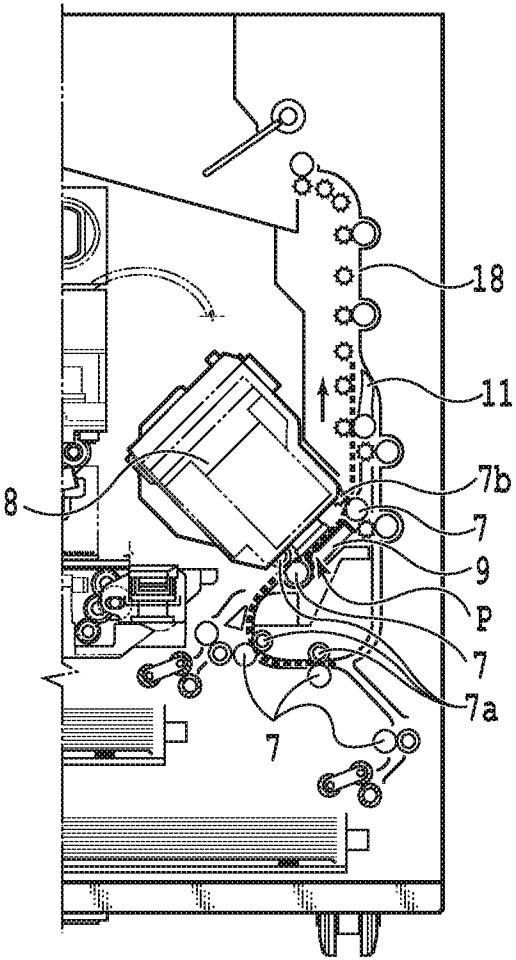
Figure 5A:
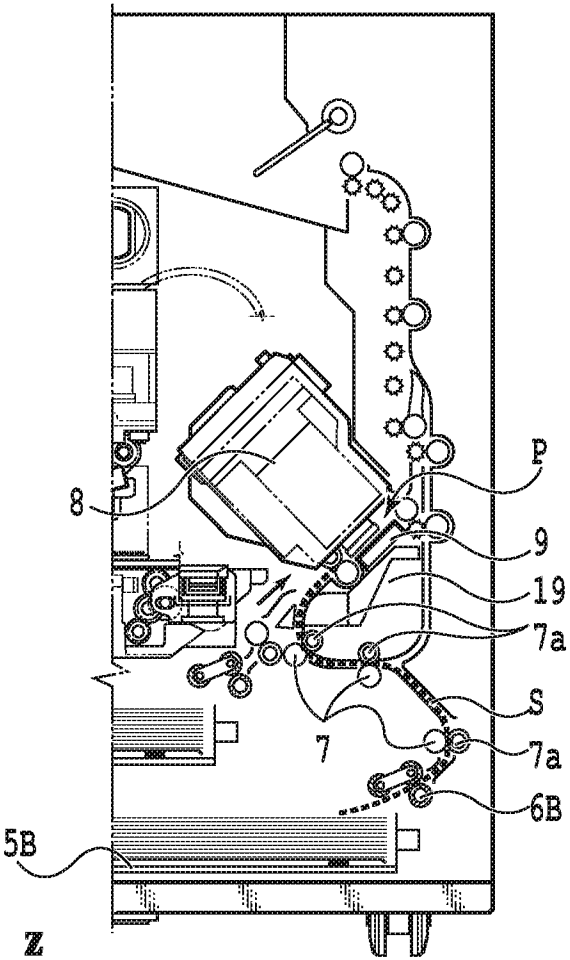

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing the print operation (duplex printing) for the back side (second side) of an A4 size print medium S. In the case of duplex printing, the print operation is first performed for the first side (front side), and is then performed for the second side (back side). A conveying procedure during the print operation for the first side is the same as that shown in FIGS. 4A to 4C and, therefore, a description will be omitted. A conveying procedure subsequent to FIG. 4C will be described below.

Figures 6A, 6B, 6C, 6D:
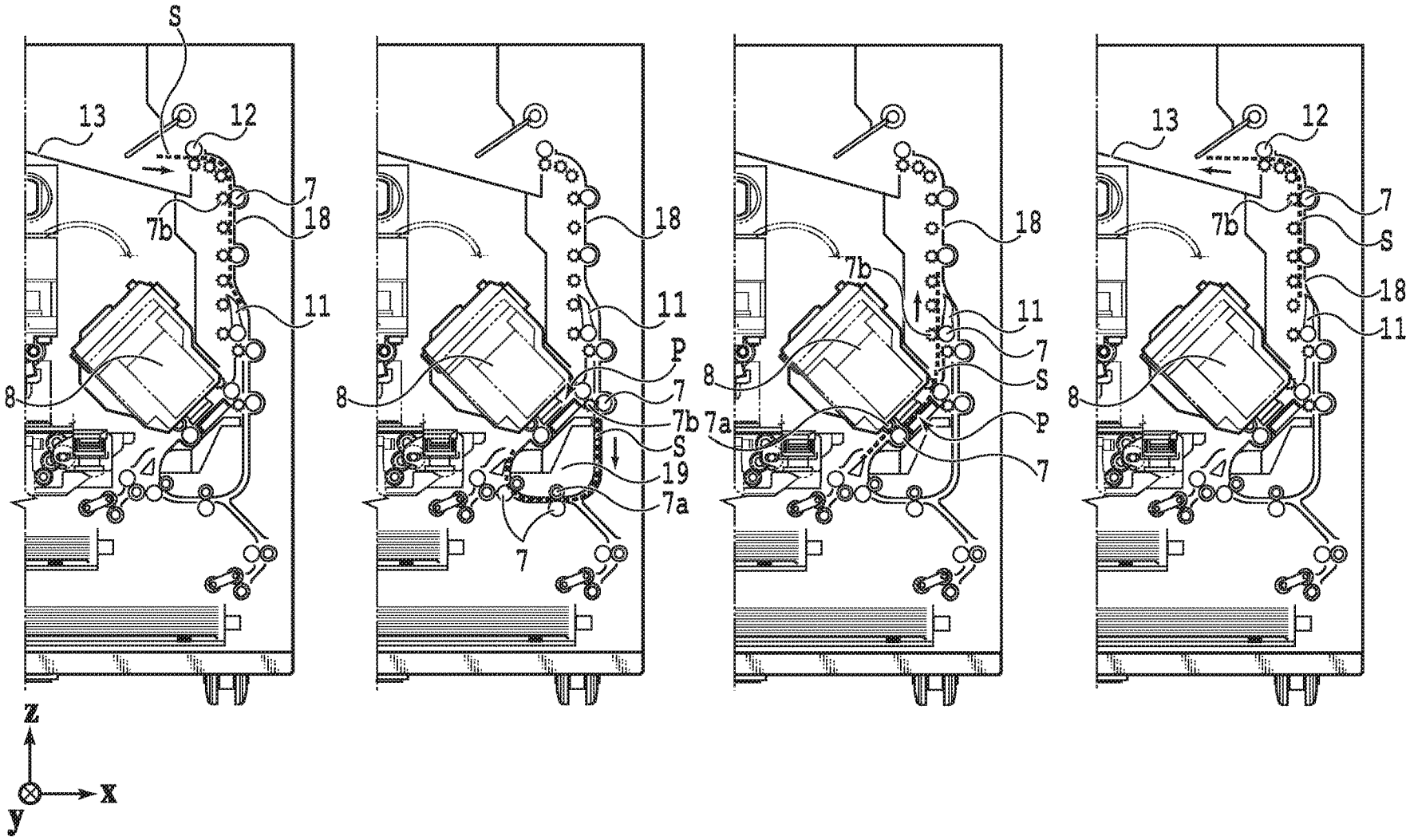
FIGS. 6A to 6D are conveying path diagrams in the case of performing print operation for the back side of a print medium.

After the print head 8 finishes the print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19, and is then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for the print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller and the print medium S is being discharged into the discharging tray 13.

Next, the maintenance operation for the print head 8 will be described. As described with reference to FIG. 1, the maintenance unit 16 of the present embodiment comprises the cap unit 10 and the wiping unit 17 and activates them at predetermined timings to perform the maintenance operation.

Figure 7:
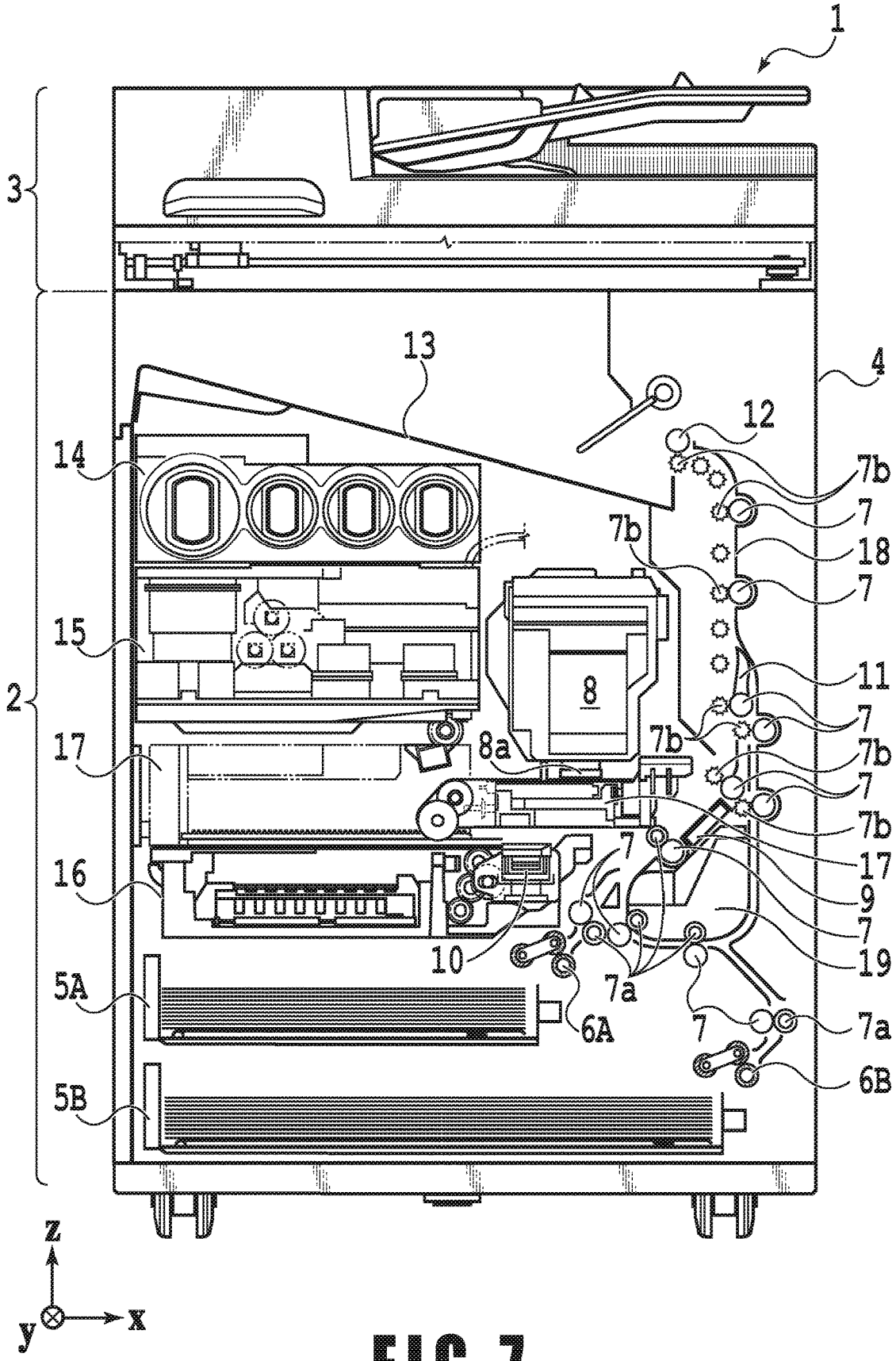
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where the maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where the maintenance operation can be performed.

Figure 8A:
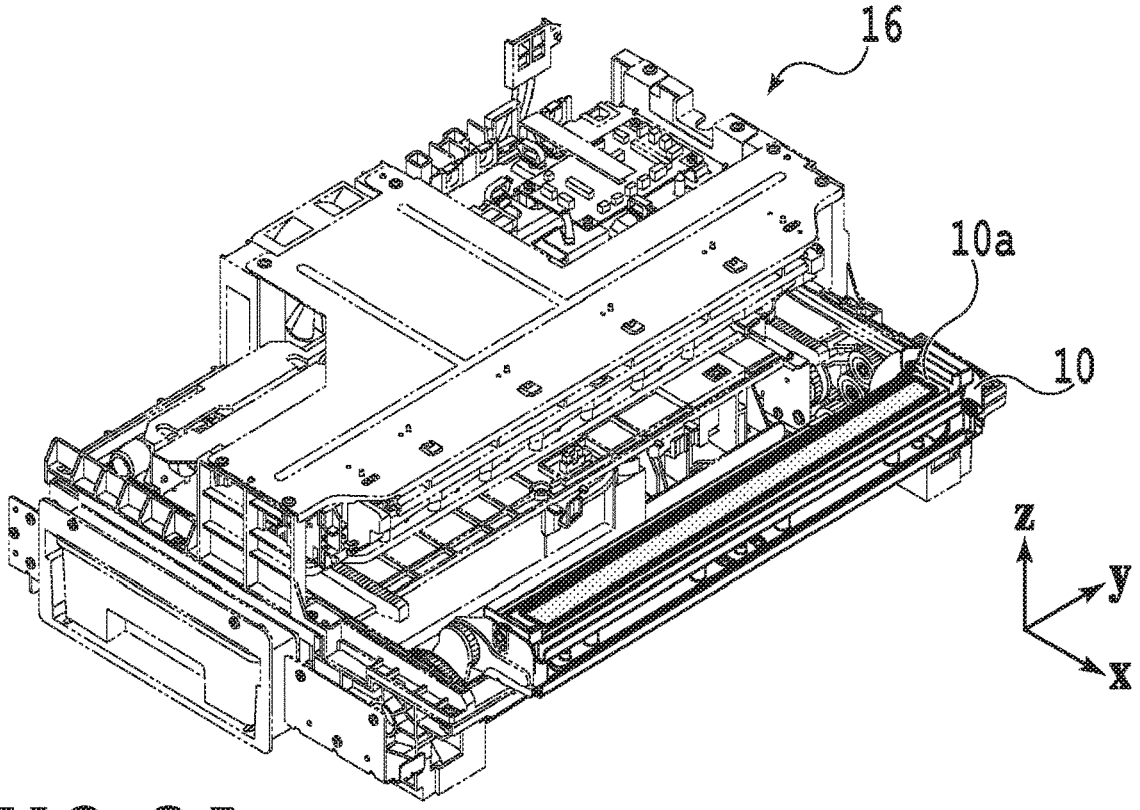
FIGS. 8A and 8B are perspective views showing the configuration of a maintenance unit.
Figure 8B:
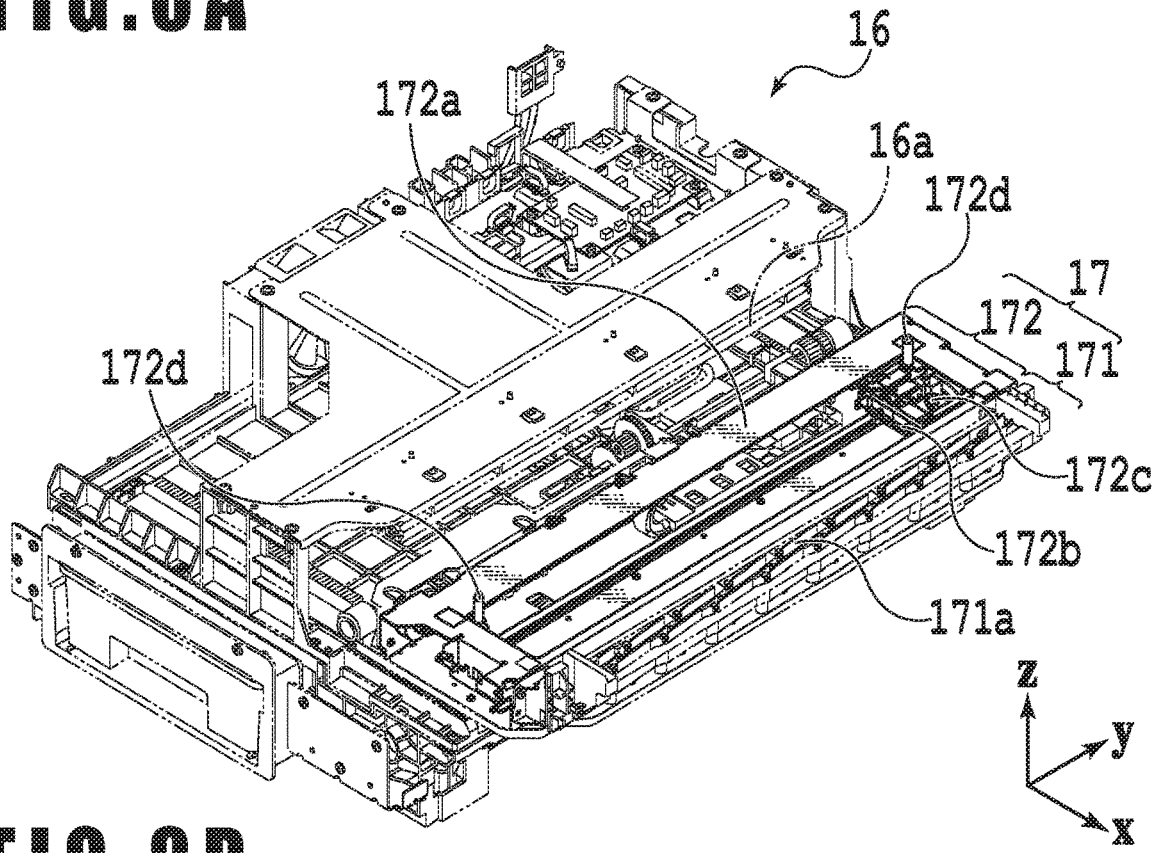

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction along the length of an area where the ejection openings are arrayed. In the case of performing a wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink, and the like, adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs the wiping operation and the vacuum wiper unit 172 does not perform the wiping operation, and a second wiping process in which both the wiper units sequentially perform the wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a*, and then moves the wiping unit 17 into the maintenance unit 16. This movement enables the blade wipers 171*a* to wipe ink, and the like, adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform the wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member 10*a* and a suction operation of suctioning collected ink in the same manner as the first wiping process.

According to the present invention described above, a printing part (ejection opening surface 8*a*) of the print head 8 is in a position within an area occupied by the second cassette 5B in the x-direction in both the standby state shown in FIG. 1 and the printing state shown in FIG. 3. The ejection opening surface 8*a* and the second cassette 5B have a positional relationship where they are overlapped in the x-direction. That is, when viewed from above the apparatus the ejection opening surface 8*a* and the second cassette 5B seem to be overlapped each other. Further, the first cassette 5A and the second cassette 5B are aligned on one side in the x-direction and the print head 8 is moved within a differential area between the first cassette 5A and the second cassette 5B in the x-direction, thereby making effective use of space. As a result, the footprint of the printing apparatus 1 can be reduced to an area substantially equivalent to a stacking unit (the second cassette 5B) for housing unprinted printing medium. It should be noted that all mechanisms including not only the print head but also the platen, conveying unit, conveying path, discharging unit, ink tank unit, and maintenance unit may be located within the area of the stacking unit (the second cassette 5B) in the x-direction.

In view of the above, according to the present embodiment, in a configuration of feeding a print medium S that is placed horizontally to the print area P, performing printing, and then conveying the print medium S vertically upward, the conveying direction of the print medium S is changed from the horizontal direction to a direction close to the vertical direction before applying ink to the print medium S. That is, although roller pairs including the conveying rollers 7 and spurs 7*b* located downstream of the print head 8 are in contact with the printed side immediately after the application of ink, the print medium S that has already become close to a vertical posture than a horizontal posture is further directed vertically. Accordingly, a contact pressure generated between the printed side and the roller pairs can be reduced compared with a configuration of changing the conveying direction of a print medium immediately after printing from the horizontal direction to the vertical direction as disclosed in U.S. Patent Application Publication No. 2014/0203499. As a result, it is possible to prevent a decrease in quality of an image on the printed side and a transfer of ink adhering to the roller pairs to a subsequent printing medium while reducing the footprint of the printing apparatus, thereby improving the quality of images on a printing medium.

In the embodiment described above, the conveying angle of a print medium S is 45° during printing, but the conveying angle is not limited to 45°. A contact pressure generated between the printed side and the roller pairs immediately after printing can be smaller than a conventional one and the advantageous result of the present invention can be produced as long as the print medium is inclined to be closer to the vertical upward plane (90°) than the horizontal plane (0°) of a stacking state.

However, if the conveying angle during printing is too close to the right angle, a reaction force exerted on a print medium by a platen against the weight of the print medium becomes small and the flatness of the printed side and a distance between sheets become unstable, which may decrease image quality. It is therefore preferable that the conveying angle of a print medium in a printing unit, that is, the installation angle of a platen is adjusted such that a problem caused by the contact force of the roller pairs acting on the printed side and a problem caused by flatness are both inconspicuous. Studies conducted by inventors of the present invention have shown that the problems can be inconspicuous and suitable images can be printed on printing medium in a case where the platen is inclined at an angle from 30° to 60° with respect to the horizontal plane, preferably from 40° to 50° with respect to the horizontal plane.

In addition, the full line type printing apparatus has been described as an example, but the present invention can also be applied to a serial type printing apparatus. In the case of a serial type printing apparatus, a print head has a length shorter in the y-direction than the print head 8 used in the embodiment described above and is movable in the y-direction. On an ejection opening surface, a plurality of ejection openings configured to eject ink of the same color are arrayed in the conveying direction. An image is gradually formed on a print medium S by alternately repeating a printing scan in which the print head is moved in the y-direction while each ejection opening ejects ink based on print data and conveying operation in which the print medium S is conveyed over a distance corresponding to the print width of the print head. In the case of such a serial type printing apparatus too, the advantageous result of the present invention can be sufficiently produced, that is, the quality of images on printing medium can be improved while reducing the footprint.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-028020 filed Feb. 17, 2017, which is hereby incorporated by reference herein in its entirety.

What is claimed is:

1. An inkjet printing apparatus comprising:

a first stacking unit configured to stack first printing sheets;

a second stacking unit located below the first stacking unit with respect to a direction of gravity, and configured to stack second printing sheets larger than the first printing sheets;

a print head having an ejection opening surface located above the first stacking unit with respect to the direction of gravity, the print head being configured to perform printing by ejecting ink onto a printing sheet fed from one of the first stacking unit and the second stacking unit;

a platen configured to support a back side of a printing sheet at a predetermined angle with respect to a horizontal direction;

a first conveying path for conveying a first printing sheet of the first printing sheets from the first stacking unit to the platen;

a second conveying path connecting a midstream of the first conveying path and the second stacking unit;

a third conveying path for inverting a printing sheet printed by the print head, the third conveying path being connected to the first conveying path via the second conveying path;

a discharging portion located above the print head with respect to the direction of gravity, a printing sheet printed by the print head being discharged onto the discharging portion; and a conveying unit configured to convey the printing sheet printed by the print head toward the discharging portion, wherein the ejection opening surface faces the platen in a case in which the inkjet printing apparatus is in a printing state, and faces downward with respect to the direction of gravity in a case in which the inkjet printing apparatus is in a standby state, wherein the ejection opening surface is located above a first area occupied by the second stacking unit and not above a second area occupied by the first stacking unit with respect to the direction of gravity, in both a case in which the inkjet printing apparatus is in the printing state, and a case in which the inkjet printing apparatus is in the standby state, and wherein a joint portion of the second conveying path and the third conveying path is located above the first area.

2. The inkjet printing apparatus according to claim 1, wherein the print head, the platen, the discharging portion, and the conveying unit are located above the area occupied by the second stacking unit with respect to the direction of gravity.

3. The inkjet printing apparatus according to claim 1, wherein the predetermined angle is 45 degrees with respect to the horizontal direction.

4. The inkjet printing apparatus according to claim 1, further comprising:

an ink tank unit configured to store the ink to be supplied to the print head; and a maintenance unit configured to perform a maintenance operation for the print head, wherein the print head, the platen, the discharging portion, the conveying unit, the ink tank unit, and the maintenance unit are located above the area occupied by the second stacking unit with respect to the direction of gravity.

5. The inkjet printing apparatus according to claim 1, wherein, on the ejection opening surface, a plurality of ejection openings configured to eject the ink are arranged in an area corresponding to a width of a printing sheet.

6. The inkjet printing apparatus according to claim 1, further comprising an ink supply unit configured to connect (a) an ink tank unit storing the ink and the print head and (b) supply the ink from the ink tank unit to the print head.

7. The inkjet printing apparatus according to claim 6, wherein the ink supply unit collects the ink from the print head.

8. The inkjet printing apparatus according to claim 7, wherein the maintenance unit moves between a first position, in which the maintenance operation can be performed, and a second position, in which the maintenance operation cannot be performed, and wherein the ink tank unit and the ink supply unit are located above the maintenance unit, in a state in which the maintenance unit is in the second position, with respect to the direction of gravity.

9. The inkjet printing apparatus according to claim 1, further comprising a cap unit configured to cap the ejection opening surface in a case in which the inkjet printing apparatus is in the standby state.

10. The inkjet printing apparatus according to claim 9, further comprising:

a wiping unit configured to wipe the ejection opening surface; and a maintenance unit that includes the cap unit and the wiping unit, the maintenance unit being configured to perform a maintenance operation, and being configured to move between a first position, in which the maintenance operation for the print head can be performed, and a second position, in which the maintenance operation cannot be performed.

11. The inkjet printing apparatus according to claim 10, wherein the wiping unit includes a blade wiper and a vacuum wiper having a suction opening connected to a suction pump.

12. The inkjet printing apparatus according to claim 11, wherein the blade wiper moves along a first direction and the vacuum wiper moves along a second direction intersecting with the first direction.

13. The inkjet printing apparatus according to claim 12, wherein, on the ejection opening surface, a plurality of ejection openings configured to eject the ink are arrayed in the second direction on the ejection opening surface.

14. The inkjet printing apparatus according to claim 1, wherein the predetermined angle is greater than 40 degrees and less than 50 degrees with respect to the horizontal direction.

* * * * *